US007039303B2

(12) United States Patent
Kimura et al.

(10) Patent No.: US 7,039,303 B2
(45) Date of Patent: May 2, 2006

(54) HEATING METHOD, HEATING APPARATUS, AND PRODUCTION METHOD OF IMAGE DISPLAY APPARATUS

(75) Inventors: Akihiro Kimura, Kanagawa (JP); Shigeto Kamata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/943,011

(22) Filed: Sep. 17, 2004

(65) Prior Publication Data

US 2005/0069309 A1 Mar. 31, 2005

(30) Foreign Application Priority Data

Sep. 30, 2003 (JP) ..... 2003-340149

(51) Int. Cl.
*F26B 19/00* (2006.01)

(52) U.S. Cl. ..... 392/416; 392/418; 219/390; 219/405; 219/411; 118/724; 118/725; 118/50.1

(58) Field of Classification Search ..... 219/390, 219/405, 411; 118/724, 725, 50.1; 392/416, 392/418

See application file for complete search history.

(56) References Cited

U.S. PATENT DOCUMENTS 6,222,990 B1 * 4/2001 Guardado et al. ..... 392/416
6,319,321 B1 * 11/2001 Hiraga et al. ..... 118/666

FOREIGN PATENT DOCUMENTS

JP 2003-59788 2/2003

* cited by examiner

*Primary Examiner*—Shawntina Fuqua
(74) *Attorney, Agent, or Firm*—Fitzpatrick, Cella, Harper & Scinto

(57) ABSTRACT

On the occasion of producing an image display apparatus, in order to suppress the bend and breakage of a substrate by uniformly heating the substrate which constructs a chamber which contains the image display apparatus, a plurality of heaters are located in opposition to both sides of the substrate in a vacuum chamber, which are further surrounded by a heat reflecting member, a partitioning member is located between end faces of the substrate and the heat reflecting member, and the substrate is heated.

10 Claims, 2 Drawing Sheets

HEATING METHOD, HEATING APPARATUS, AND PRODUCTION METHOD OF IMAGE DISPLAY APPARATUS

BACKGROUND OF THE INVENTION

1. Field of the Invention

The present invention relates to a heating method and a heating apparatus which heats a substrate under a depressurized atmosphere. Furthermore, the present invention relates to a production method of an image display apparatus using a substrate heated by the heating method.

2. Related Background Art

Heretofore, a substrate may be heat-treated when producing the substrate which constitutes a predetermined apparatus.

A substrate heating apparatus for performing heat treatment is described in Japanese Patent Application Laid-Open No. 2003-59788.

The substrate heating apparatus described in Japanese Patent Application Laid-Open No. 2003-59788 comprises a stage, a heat reflecting plate placed on the stage, and a heating plate which is placed on the reflecting plate, and on which a substrate is placed. In this construction, the heat reflecting plate is located between the stage and heating plate, and the heating plate is located between the substrate and heat reflecting plate.

Furthermore, a path in which cooling water passes is formed in this stage, and a heat-reflecting ring is provided around the heating plate.

In the substrate heating apparatus described in Japanese Patent Application Laid-Open No. 2003-59788, heat emitted from the heating plate is reflected by the heat reflecting plate. Further, since the substrate is also heated by this reflected heat, it becomes possible to increase a heating rate of the substrate.

Nevertheless, the substrate heating apparatus described in Japanese Patent Application Laid-Open No. 2003-59788 has such construction that the heating plate under the substrate directly heats the substrate and the heat reflecting plate reflects the heat emitted from the heating plate to make the heat go to the substrate again. Thus, it is not such constitution that heats a surface of the substrate which is not in contact with the heating plate.

Hence, there is a problem that it is not possible to heat the substrate uniformly, and in consequence, the substrate bends to damage.

SUMMARY OF THE INVENTION

It is an object of the present invention to provide a heating method and a heating apparatus which can heat a substrate uniformly without bending and damaging the substrate as a result, and a production method of an image display apparatus using the substrate heat-treated by the heating method.

DETAILED DESCRIPTION OF THE PREFERRED EMBODIMENTS

Figure 1:
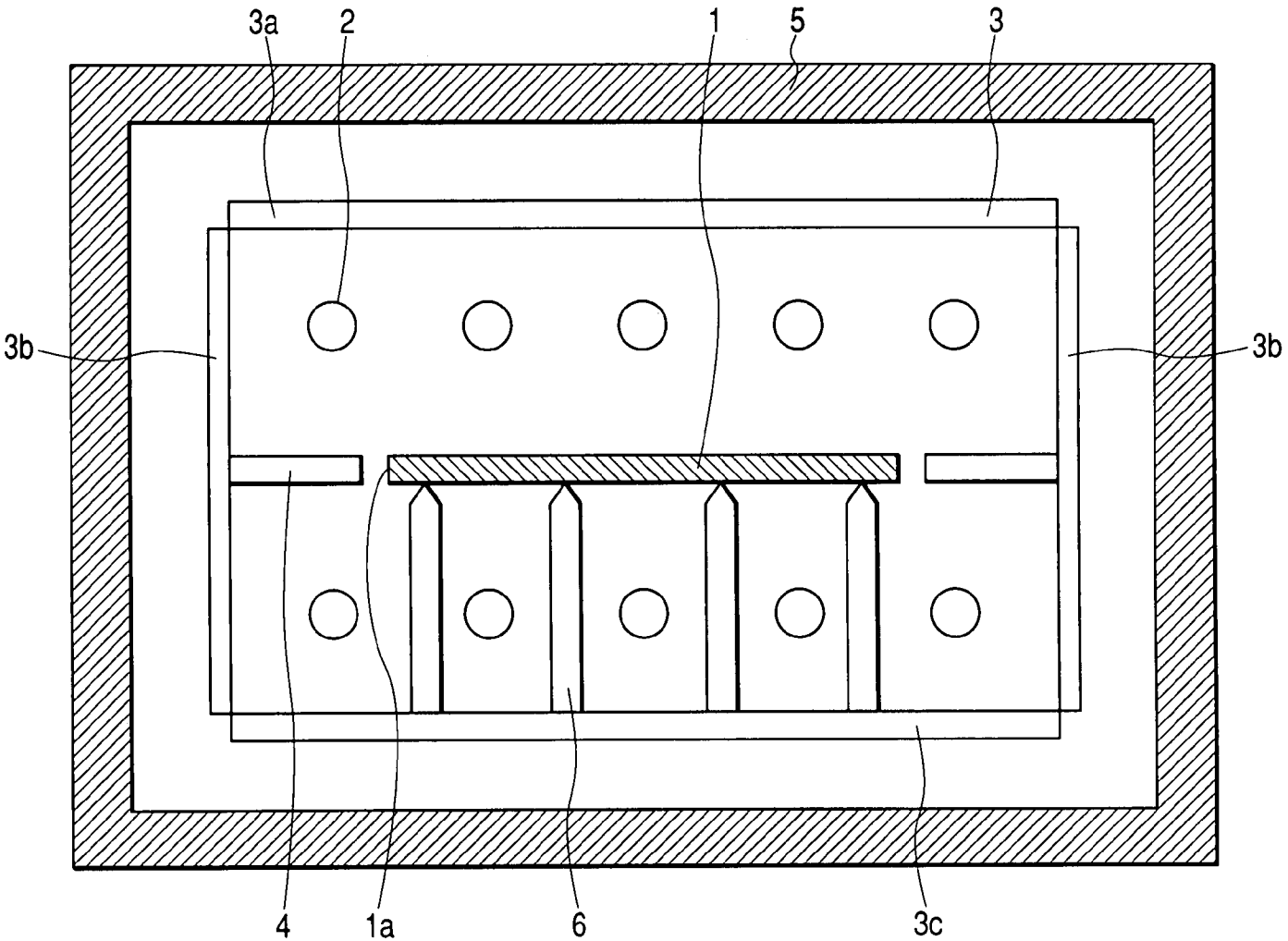
FIG. 1 is a sectional view schematically showing an embodiment of a heating method and the construction of a heating apparatus according to the present invention.

A heating method of the present invention uses a heating apparatus comprising a supporting member supporting a substrate, a plurality of heaters located in opposition to both sides of this substrate and heating the substrate, a heat reflecting member surrounding the substrate and the plurality of heaters, and a vacuum chamber containing the supporting member, heaters, and heat reflecting member, in which a partitioning member is located in an area between peripheral end faces of the substrate, and the heat reflecting member, wherein the substrate is heated by the heaters and the heat reflecting member within a depressurized atmosphere formed by evacuating the vacuum chamber.

In addition, a heating apparatus of the present invention comprises a supporting member supporting a substrate, a plurality of heaters which are located in opposition to both sides of this substrate and heat the substrate, a heat reflecting member surrounding the substrate and the plurality of heaters, and a vacuum chamber containing the supporting member, heaters, and heat reflecting member, wherein a partitioning member is placed in an area between peripheral end faces of the substrate, and the heat reflecting member.

In this heating apparatus, it is preferable that the partitioning member is formed of the same material as the substrate. In addition, it is preferable that the partitioning member is a member which has the same emissivity or heat capacity as the substrate. The substrate and partitioning member may be formed of glass.

In addition, it is preferable that each end face of the partitioning member which faces each peripheral end face of the substrate is larger than each peripheral end face of the substrate.

Furthermore, the present invention is a production method of an image display apparatus comprising image display means and a chamber which contains the image display means, and includes a production method of an image display apparatus which has a step of heat-treating a substrate, which is a component of the chamber, with the heating method or heating apparatus.

In the invention constructed as mentioned above, the substrate to be heat-treated is supported by the supporting member, and the front and back sides of this substrate, and the plurality of heaters are located with facing each other. Furthermore, the heat-reflecting member surrounds the substrate and plurality of heaters. Then, the partitioning member is installed in the area between peripheral end faces of the substrate and the heat reflecting member, it is possible to prevent the heat of the heaters, located on the front side and back side of the substrate, from rounding from one side of the substrate to another side. Hence, the heat is uniformly transmitted to the substrate and partitioning member.

As mentioned above, according to the present invention, it is possible to perform heat treatment without bending or damaging a substrate since it is possible to heat the substrate keeping a thermal uniformity.

Hereafter, embodiments of the present invention will be described with referring to drawings, but the present invention is not limited to such embodiments.

FIG. 1 is a sectional view schematically showing an embodiment of a heating method and the construction of a heating apparatus according to the present invention.

In FIG. 1, a heat-reflecting member 3 is located inside a chamber 5 which forms a space. The heat reflecting member 3 forms an enclosure with a plurality of plates, and in this embodiment, it is constructed by connecting a top plate 3*a*, left and right side plates 3*b*, and a bottom plate 3*c*.

A plurality of support pins 6 are stood on the bottom plate 3*c* which constructs a part of the heat-reflecting member 3. The substrate 1 to be heat-treated is supported on the ends of these support pins 6.

Inside the heat-reflecting member 3, a plurality of heaters 2 are located at predetermined intervals. The heaters 2 are located in front and back sides of the substrate 1 with facing each other. Owing to the above, such construction that the heat-reflecting member (reflector) 3 is located around the substrate 1 and a heater 2 is achieved.

Furthermore, a partitioning member (partition) 4 is on an extension line of a constructive face of the substrate 1 and is provided in an area between peripheral end faces la of the substrate and the (side plates 3*b* of) heat-reflecting member 3. It is preferable that a gap between each peripheral end face 1*a* of the substrate and the partitioning member 4 is 5 to 20 mm.

A vacuum pump (not shown) for depressurizing is annexed to the chamber 5, and evacuates the inside of the chamber 5 to form a depressurized atmosphere. The heaters 2 generate heat in this state to heat-treat the substrate 1.

According to this embodiment, since a partitioning member 4 which is on an extension line of a constructive face of the substrate 1 and is installed in an area between the peripheral end faces 1*a* of the substrate and the heat reflecting member 3, it is possible to prevent the heat of the heaters 2, located on the front side and back side of the substrate 1, from rounding from one side of the substrate 1 to another side. Hence, the heat is uniformly transmitted to the substrate 1 and partitioning member 4.

Hence, it is possible to perform heat treatment without bending or damaging the substrate 1 since it is possible to heat the substrate 1 keeping a thermal uniformity.

EXAMPLES

Figure 2:
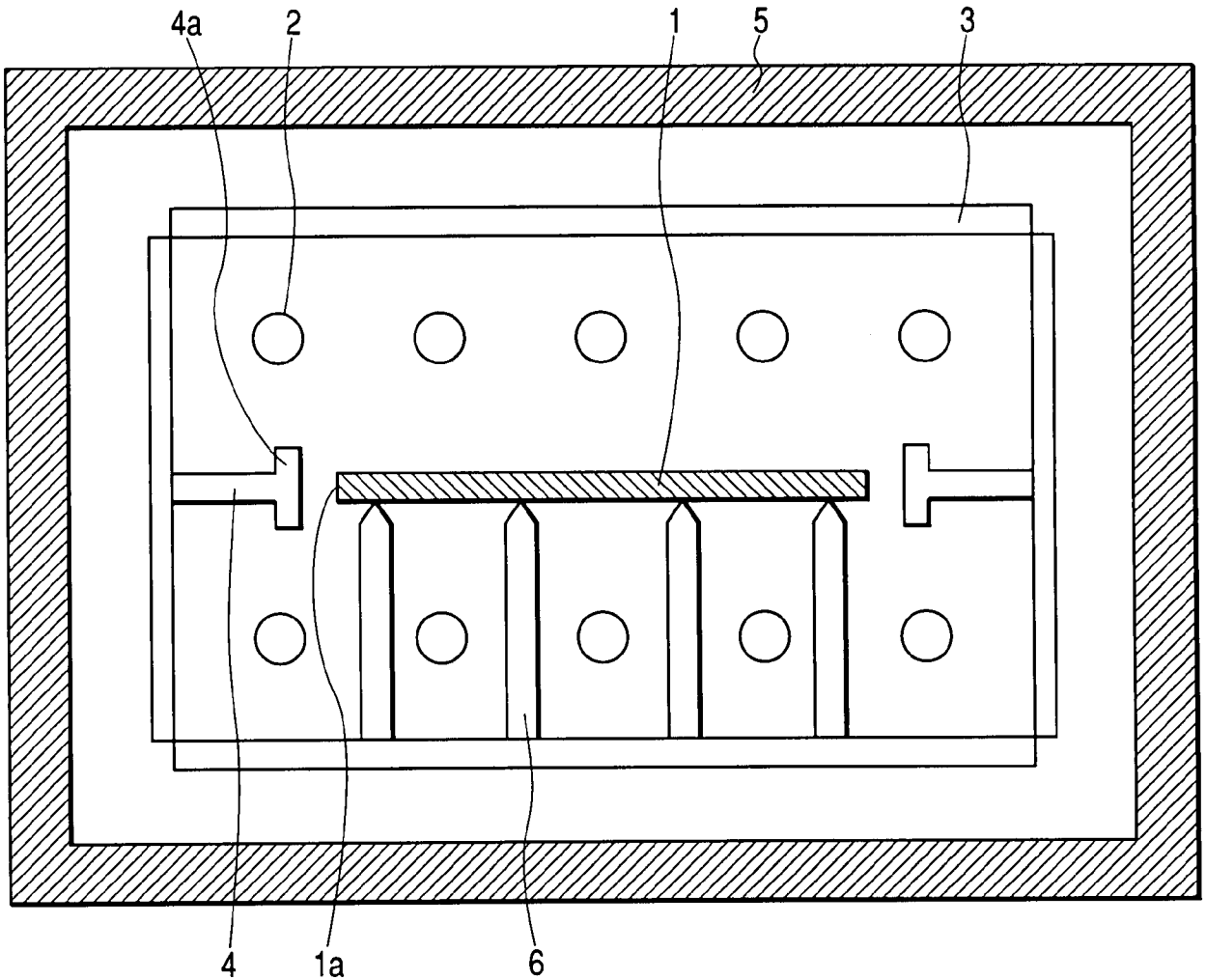
FIG. 2 is a sectional view showing another form of the heating apparatus shown in FIG. 1.

Although examples in the present invention will be explained below in detail, the present invention is not limited to such examples. In addition, the same reference numerals as those of the parts shown in FIG. 1 and 2 are used for components cited in examples.

Example 1

In this example, glass with 600 mm×900 mm×2.8 mm thick was used as a material of the substrate 1, a member which is given paper finishing on a surface of copper was used as the heat reflecting member 3, and the area surrounded by the heat reflecting member 3 was made to be 1000 mm long×700 mm wide. The same glass as that of the substrate 1, whose thickness is 2.8 mm was used as the partitioning member 4 which was on the extension line of the constructive face of the substrate 1 and was located in an area between the substrate 1 and heat-reflecting member 3. An indium film is applied to a part of a front side of the substrate 1 (not shown). Sheath heaters were used for the heaters 2 which heated the substrate 1.

In FIG. 1, the substrate 1 was placed on the support pins 6 with being positioned. After the placement of the substrate 1, the inside of the chamber 5 was evacuated up to $2\times10^{-6}$ Pa. After the inside of the chamber 5 was depressurized, the heaters (sheath heaters) 2 were heated to 750° C. for 10 minutes. The substrate 1 was heated to 400° C. by heating by the heaters (sheath heaters) 2, and heating was kept for 30 minutes in this state to degas the substrate 1.

When the substrate was heat-treated by the above method, since the substrate 1 and partitioning member 4 had the same thickness and the same material, that is, their emissivity's were also the same, their temperature during heating became equal, and hence, heat transfer did not arise between the substrate 1 and partitioning member 4.

In addition, since the partitioning member 4 was installed, it was possible to uniformly heat the substrate 1 during processing without a trouble that the heat of the heaters 2 located on the upper and lower sides of the substrate 1 transmitted mutually to the opposite sides of the substrate 1. It was confirmed that neither the bend nor the breakage of the substrate 1 arose owing to this. In addition, since the bend of the substrate 1 did not arise, it did not arise that the indium applied to the part of the substrates 1 dissolved and flowed into other parts.

Example 2

In this example, fundamental construction is the same as that of the first example. Glass with 2.8 mm thick and heat capacity of $2.1\times10^{6}$ J/m$^{3}$° C. was used for the substrate 1, and stainless steel with 1.5 mm thick and heat capacity of $4.0\times10^{6}$ J/m$^{3}$° C. was used as the partitioning member 4 which was on the extension line of a substrate face and was located in an area between the substrate 1 and heat reflecting member 3. Other members were the same as those in the first example.

When the same heat treatment as that in the first example was performed in the construction, the substrate 1 and partitioning member 4 in FIG. 1 were almost equal in heat capacity per unit area, and hence, the temperature of the substrate 1 and partitioning member 4 rose at the same temperature during processing. Hence, since there was no heat transfer between the substrate 1 and partitioning member 4, it was possible to heat-treat the substrate 1 uniformly. Thereby, it was possible to confirm the same effects as those in the first example.

Example 3

FIG. 2 is a sectional view showing another form of the heating apparatus shown in FIG. 1.

In this example, fundamental construction is the same as that of the first example. End faces of the partitioning member 4 were made rib shapes (protrusions 4*a*) protruding upward and downward by 5 mm respectively than the thickness of the peripheral end faces 1*a* of the substrate as shown in FIG. 2. Furthermore, a gap between each peripheral end face 1*a* of the substrate and each end section (protrusion 4*a*) of the partitioning member 4 was set at 5 mm.

When the same heat treatment as that in the first example was performed in the construction, heat from the heaters which entered into the end faces of the substrate 1 was prevented, and hence, it was possible to confirm that a temperature distribution could be sharpened. It was confirmed that neither the bend nor the breakage of the substrate 1 arose owing to this.

In addition, the present invention is not limited to each of the examples, and it is needless to say that various types of modification are possible.

For example, a substrate which constructs a chamber which contains an image display section may be used as the substrate 1. Saying in other words, in a production method of an image display apparatus including an image display section, and a chamber which contains the image display section, a substrate which constructs the chamber which contains an image display section may be heat-treated by the method. In this case, it is possible to uniformly heat the substrate which constructs the chamber which contains the image display section, and to lower a possibility of the bend and breakage of the substrate arising at the time of heating.

This application claims priority from Japanese Patent Application No. 2003-340149 filed Sep. 30, 2003, which is hereby incorporated by reference herein.

What is claimed is:

1. A heating method, using a heating apparatus comprising:

a supporting member supporting a substrate;

a plurality of heaters disposed in opposition to both sides of the substrate for heating the substrate;

a heat reflecting member surrounding the substrate and the plurality of heaters; and a vacuum chamber containing the supporting member, the heaters, and the heat reflecting member, in which a partitioning member is located in an area between peripheral end faces of the substrate and the heat reflecting member and suppresses propagation of heat from a first side of the substrate to a second side of the substrate, said method comprising the step of:

heating the substrate by the heaters and the heat reflecting member within a depressurized atmosphere formed by evacuating the vacuum chamber.

2. A heating apparatus, comprising:

a supporting member supporting a substrate;

a plurality of heaters disposed in opposition to both sides of the substrate for heating the substrate;

a heat reflecting member surrounding the substrate and the plurality of heaters; and a vacuum chamber containing the supporting member, the heaters, and the heat-reflecting member, wherein a partitioning member is placed in an area between peripheral end faces of the substrate and the heat-reflecting member and suppresses propagation of heat from a first side of the substrate to a second side of the substrate.

3. The heating apparatus according to claim 2, wherein the partitioning member is formed of the same material as that of the substrate.

4. The heating apparatus according to claim 2, wherein the partitioning member is a member having the same emissivity as the substrate.

5. The heating apparatus according to claim 2, wherein the partitioning member is a member having the same heat capacity as the substrate.

6. The heating apparatus according to claim 2, wherein the substrate and the partitioning member are formed of glass.

7. The heating apparatus according to any one of claims 2 to 6, wherein each end face of the partitioning member which faces each peripheral end face of the substrate is larger than each peripheral end face of the substrate.

8. A production method of an image display apparatus which has image display means, and a chamber which contains the image display means, comprising a step of heat-treating a substrate, which is a component of the chamber, by the method according to claim 1.

9. A production method of an image display apparatus which has image display means, and a chamber which contains the image display means, comprising a step of heat-treating a substrate, which is a component of the chamber, by a method using the heating apparatus according to any one of claims 2 to 6.

10. A production method of an image display apparatus which has image display means, and a chamber which contains the image display means, comprising a step of heat-treating a substrate, which is a component of the chamber, by a method using the heating apparatus according to claim 7.

* * * * *

UNITED STATES PATENT AND TRADEMARK OFFICE

CERTIFICATE OF CORRECTION

PATENT NO. : 7,039,303 B2
APPLICATION NO. : 10/943011
DATED : May 2, 2006
INVENTOR(S) : Akihiro Kimura et al.

It is certified that error appears in the above-identified patent and that said Letters Patent is hereby corrected as shown below:

COLUMN 4:

Line 3, “emissivity’s” should read --emissivities--.
Line 46, “than” should read --with respect to--.

Signed and Sealed this

Twenty-sixth Day of December, 2006

JON W. DUDAS
*Director of the United States Patent and Trademark Office*